United States Patent [19]

Petrow

[11] Patent Number: 4,673,906

[45] Date of Patent: Jun. 16, 1987

[54] CRT DEFLECTION YOKE WITH RIGIDIFYING MEANS

[75] Inventor: William M. Petrow, Prospect Heights, Ill.

[73] Assignee: Zenith Electronics Corporation, Glenview, Ill.

[21] Appl. No.: 870,067

[22] Filed: Jun. 3, 1986

[51] Int. Cl.[4] ..... H01F 7/00

[52] U.S. Cl. ..... 335/210; 335/217

[58] Field of Search ..... 335/210, 211, 212, 217

[56] References Cited

U.S. PATENT DOCUMENTS

| | | | |
|---|---|---|---|
| 3,764,740 | 10/1973 | Deal | 335/210 X |
| 3,873,877 | 3/1975 | Machida et al. | 335/217 X |
| 4,494,097 | 1/1985 | Lenders | 335/210 X |

OTHER PUBLICATIONS

Article from Adhesives Age Magazine, Sep. 1982, p. 25, entitled "Foamed Hot Melt Adhesives" by Frank T. Hughes.

*Primary Examiner*—George Harris

*Attorney, Agent, or Firm*—Cornelius J. O'Connor; Thomas E. Hill

[57] ABSTRACT

Magnetic field formers in a cathode ray tube (CRT) deflection yoke for controlling the position of an electron beam in the CRT are secured to and maintained in position on the yoke by means of a foamed hot melt adhesive. An inert gas such as nitrogen or carbon dioxide is introduced in a volumetrically metered manner into a hot melt adhesive which may be polyethylene, polypropylene or any number of other thermoplastics to form a foamed adhesive containing a large volume of gas bubbles. The foamed hot melt fluid is then deposited between the magnetic field formers and various other portions of the deflection yoke to provide magnetic field former support and yoke strength, eliminate deflection yoke hot spots, dampen out yoke vibration modes, and reduce the cost of the deflection yoke.

9 Claims, 7 Drawing Figures

CRT DEFLECTION YOKE WITH RIGIDIFYING MEANS

BACKGROUND OF THE INVENTION

This invention relates generally to magnetic deflection yokes as used in cathode ray tubes (CRTs) for displacing an electron beam therein and is particularly directed to the assembly and fabrication of CRT magnetic deflection yokes employing magnetic field formers.

An electromagnetic deflection yoke as used in a CRT for controlling the position of an electron beam on the CRT's faceplate generally includes two pairs of deflection coils. One pair of coils provides for vertical deflection of the electron beam, or beams as in the case of a color CRT, while the other pair of deflection coils provides horizontal electron beam deflection. The deflection yoke is generally disposed around the neck and funnel portions of the CRT and is securely mounted thereto so as to generate a precisely controlled magnetic field within the CRT which acts upon and displaces the electron beam therein in a predictable manner. The electron beam is deflected at a first, higher rate horizontally and at a second, lower rate vertically so as to trace a raster scanned pattern upon the CRT's faceplate.

In general, a pair of ferrite cores are symmetrically disposed around the electron beams and oriented generally transverse to the direction of travel of the electrons. A pair of vertical windings are wrapped around each of the ferrite cores and provide for varying the magnetic field to allow the electron beam to be deflected upward in a stepwise manner after each horizontal sweep followed by full vertical deflection of the electron beam after the CRT's faceplate has been completely traced to re-position the electron beam for initiating another raster scan trace of the CRT's faceplate. A pair of horizontal deflection coils are positioned symmetrically about the axis of the electron beams and disposed within the ferrite cores for horizontally deflecting the electron beam across the CRT's faceplate. Additional electromagnetic components such as color purity coils and magnetic field formers are also typically included in the deflection yoke for exercising improved control over the electron deflecting magnetic field for enhanced video image sharpness, color and definition.

In order to generate magnetic fields of sufficient intensity, the aforementioned deflection coils must carry large currents. These large currents, in turn, produce substantial heat within the deflection coils and immediately adjacent deflection yoke components. Excessive heat causes thermal distortion of deflection yoke components resulting in beam landing errors on the CRT's faceplate. The deflection yoke must therefore be assembled with components and materials capable of withstanding a high temperature environment while remaining in a rigid, fixed configuration capable of providing stable, predictable magnetic deflection fields.

The typical deflection yoke includes a plastic housing comprised of two half portions which are securely joined by snap-acting connectors. The ferrite core also is generally comprised of two half portions which are positioned about the outer portion of the yoke housing and are maintained in position thereon by means of metal clips. The current carrying magnetic deflection coils are either wound about respective ferrite core portions (vertical deflection coils) or are positioned in intimate contact with and mounted upon the yoke housing (horizontal deflection coils). A synthetic resin in combination with a contact adhesive may be used for maintaining the aforementioned vertical and horizontal windings on the ferrite core and yoke housing as disclosed in U.S. Pat. No. 4,494,097 to Lenders. The synthetic resin is used as a filler and possesses a coefficient of thermal conductivity to provide for the dissipation of thermal energy produced in the deflection coils. The contact adhesive maintains the deflection coils in intimate contact with the yoke structure upon which they are mounted.

Similar arrangements have been used to position the aforementioned magnetic field forming structures on the deflection yoke with only limited success. The metallic field formers are particularly sensitive to "hot spots" and it is therefore essential that the heat to which these elements are exposed be minimized and that the associated thermal energy be distributed uniformly within these field forming elements. Prior art approaches in this area have suffered from the presence of gaps within the field former mounting arrangement which not only reduce heat transmission from the field former, but also reduce the support for and stability of the field forming element as mounted upon the deflection yoke. With the field forming element not securely mounted upon the deflection yoke, it is subject to low frequency vibration such as arising from the 60 Hz line voltage provided to the CRT. Vibration of the field forming element appears as jitter on the CRT's faceplate which in combination with deformation of the field forming element arising from hot spots seriously degrades video image quality. Finally, since the field forming elements are fairly large, generally extending substantially around the entire circumference of the deflection yoke housing, a substantial amount of adhesive material is required for securing the field forming element to the yoke. The use of such materials increases the cost of CRT yoke manufacture.

The present invention is intended to overcome the aforementioned limitations of the prior art by providing rigidifying means for use in a CRT deflection yoke comprised of a hot melt, foamed adhesive which is extruded in liquid form on the field forming elements of the deflection yoke when in position thereon so as to securely and stably mount the field forming element on the deflection yoke. The foamed adhesive provides improved thermal conductivity and heat dissipation and increased mounting strength for the field forming element. By foaming the hot melt adhesive, the required amount of adhesive material may be substantially reduced, e.g., by as much as 70%, resulting in a corresponding reduction in deflection yoke cost.

OBJECTS OF THE INVENTION

Accordingly, it is an object of the present invention to provide an improved magnetic deflection yoke in a CRT.

It is another object of the present invention to reduce the cost of and improve the operating performance of a CRT deflection yoke.

Additional objects of the present invention are to improve the structural support for as well as to increase the bonding strength of components in a magnetic deflection yoke.

A further object of the present invention is to provide enhanced thermal dissipation during assembly of a CRT deflection yoke thus reducing/eliminating deformation of polymeric components which adversely affect performance.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 1:
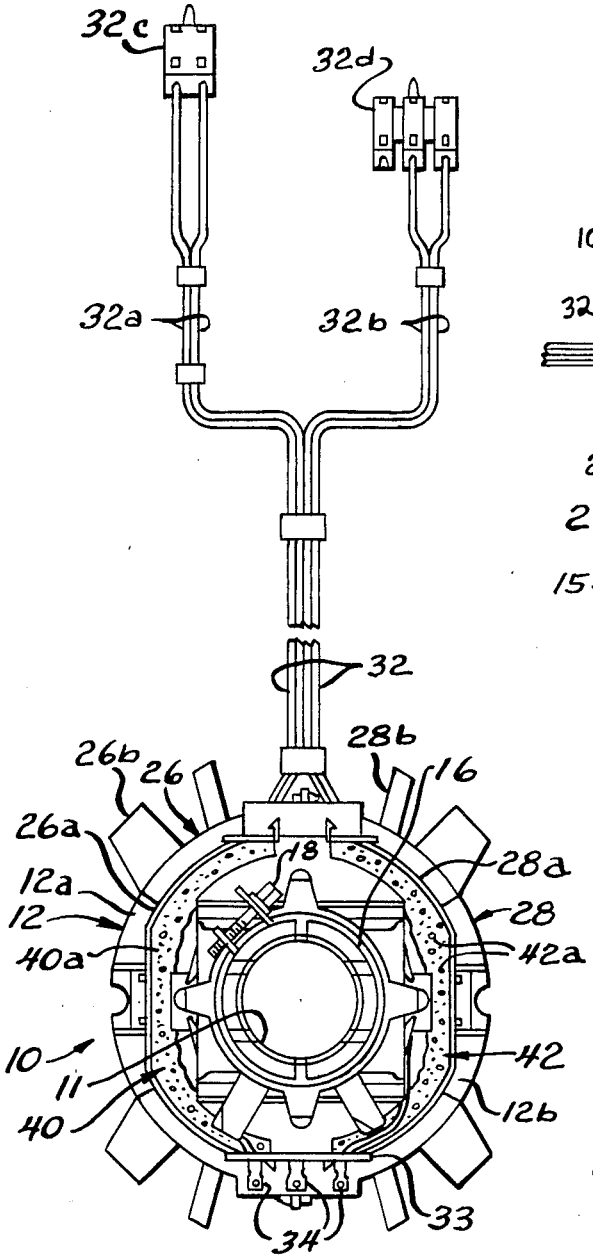
FIG. 1 is a top plan view of a CRT deflection yoke with rigidifying means in accordance with the present invention.
Figure 2:
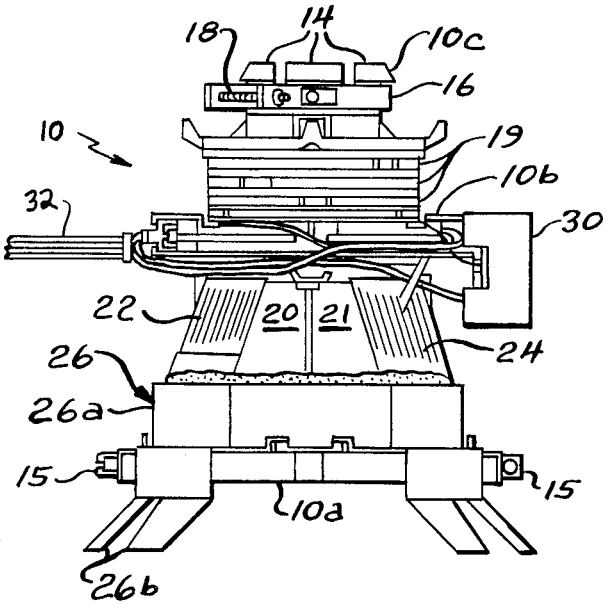
FIG. 2 is a lateral view of the CRT deflection yoke of FIG. 1.
Figure 3:
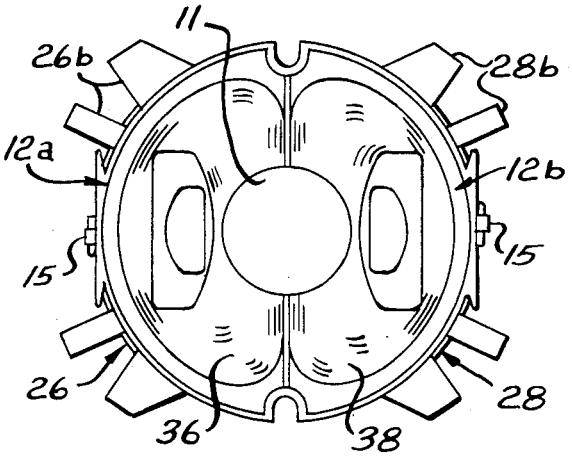
FIG. 3 is a bottom plan view of the CRT deflection yoke of FIG. 1.

Referring to FIGS. 1, 2 and 3, there are respectively shown top, lateral and bottom plan views of a CRT deflection yoke 10 with rigidifying means in accordance with the present invention.

The CRT deflection yoke 10 includes first and second housing sections 12*a*, 12*b* which are each in the general form of a semi-circular, elongated member and which when joined form a generally cylindrical housing having an inner, center aperture 11 extending the length thereof. The first and second housing sections 12*a*, 12*b* may include a plurality of snap-acting connections 15 by means of which the two housing sections may be coupled in a secure manner. When thus joined along the respective lengths thereof, the first and second housing sections 12*a*, 12*b* form a yoke housing/liner 12 typically comprised of a plastic material and including an expanded end portion 10*a*, an expanded intermediate portion 10*b* and a narrow attachment end 10*c*.

The narrow attachment end 10*c* includes a plurality of flexible end members 14 which are adapted for engagement by a generally circular neck clamp 16. The neck of a CRT (not shown) is adapted for insertion within the center aperture 11 of the CRT deflection yoke 10 and substantially along the length thereof. The ends of the neck clamp 16 are adapted for engagement by a threaded member such as a bolt 18 by means of which the clamp may be tightened about the flexible end members 14 of the narrow attachment end 10*c* of the deflection yoke 10 for engagement with and mounting upon the neck portion of a CRT positioned within the yoke's center aperture 11. It is in this manner that the deflection yoke 10 may be securely mounted to a CRT.

Positioned between the narrow attachment end 10*c* and the expanded intermediate portion 10*b* of the yoke housing/liner 12 are a plurality of rotationally displaceable color purity coils 19. The color purity coils 19 allow for manual adjustment of the respective magnetic fields controlling the three electron beams forming the three primary colors of red, green and blue in a color CRT. The expanded intermediate portion 10*b* of the yoke housing/liner 12 includes a plurality of grooves for receiving various conductors forming a wiring harness 32. The wiring harness 32 includes first and second pairs of conductors 32*a*, 32*b* which are respectively coupled to first and second connectors 32*c*, 32*d*. The first pair of conductors 32*a* is further coupled to first and second vertical coils 22, 24. Similarly, the second pair of conductors 32*b* is coupled to first and second horizontal coils 36, 38. By means of the first pair of conductors 32*a* and the first connector 32*c*, the first and second vertical coils 22, 24 may be coupled to a DC power supply (not shown) for energizing the vertical deflection coils. Similarly, by means of the second pair of conductors 32*b* and the second connector 32*d*, the first and second horizontal coils 36, 38 may be coupled to a DC power supply for energizing the horizontal deflection coils.

Mounted to the expanded intermediate portion 10*b* of the yoke housing/liner 12 is a connector board 33 which includes a plurality of contacts/terminals 34 thereon. The first and second pairs of conductors 32*a*, 32*b* as well as the first and second vertical coils 22, 24 and the first and second horizontal coils 36, 38 are coupled to various of the contacts/terminals 34 on the connector board 33. The DC voltages at the contacts/terminals 34 on the connector board 33 may be coupled by suitable conductors to various subsystems and components of the video display system within which the CRT is used for energizing these subsystems and components. The CRT deflection yoke 10 of the present invention is adapted for use in any video display system such as a television receiver or computer terminal within which a conventional CRT is used. A snap-acting plastic cover 30 is adapted for mounting upon the connector board 33 for covering the various contacts/terminals 34 thereon.

Positioned on lateral, intermediate portions of the first and second housing sections 12*a*, 12*b* and disposed about the circumference of the yoke housing/liner 12 are first and second ferrite cores 20, 21. Wrapped around the first ferrite core 20 is a first vertical coil 22, while wrapped around the second ferrite core 21 is a second vertical coil 24. Each of the first and second ferrite cores 20, 21 is generally semi-circular in shape and is adapted for tight fitting engagement about an intermediate, peripheral portion of the yoke housing/liner 12. The first and second ferrite cores 20, 21 as well as the first and second vertical coils 22, 24 are arranged generally symmetrically about the center aperture 11 of the yoke housing/liner 12 within which the neck of a CRT is positioned.

In accordance with the present invention, first and second magnetic field formers 26, 28 are positioned upon the expanded end portion 10*a* of the CRT deflection yoke 10. The first field former 26 includes an upper portion 26*a* and a lower segmented portion 26*b*. Similarly, the second field former 28 includes an upper portion 28*a* and a lower segmented portion 28*b*. The upper portions 26*a*, 28*a* of the first and second field formers 26, 28 are positioned adjacent to and immediately outward from the combination of a respective ferrite core and vertical coil wound thereon. The respective lower segmented portions 26*b*, 28*b* of the first and second field formers 26, 28 are comprised of a plurality of outwardly extending, spaced wings which are adapted for engagement with the funnel portion of a CRT (not shown). The lower segmented portions of the field formers provide proper alignment and spacing of the CRT deflection yoke 10 with respect to a CRT upon which it is mounted.

First and second foamed adhesive portions 40, 42 are respectively deposited between a ferrite core/vertical coil combination and the first and second field formers 26, 28. In a preferred embodiment, the hot melt adhesive is polyethylene, polypropylene, or other thermoplastic material which can be easily heated to liquid form and extruded from a nozzle and allowed to set to form an adhesive bond of high strength. The first and second foam adhesive portions 40, 42 each includes a respective plurality of bubbles or voids 40*a*, 42*a* formed by introducing a gas such as nitrogen or carbon dioxide into the hot melt adhesive in a volumetrically metered fashion in a manner well known to those skilled in the art. The extent of gas dispersement within the hot melt adhesive material, or its gas content, is determined by the pressure of the gas thus introduced and in a preferred embodiment may be varied from 20% to 70% in volume of the adhesive material/gas combination. By increasing the percentage of gas bubbles within the foam adhesive portions 40, 42, the amount of adhesive material may be substantially reduced to lower the cost of deflection yoke manufacture. In addition, increasing the number of bubbles or voids within the foam adhesive material reduces hot spots during application. This reduces deflection yoke distortions and changes in its physical dimensions to provide more accurate and reliable electron beam deflection and improved video image quality. Furthermore, providing a high volume of bubbles within the foamed hot melt adhesive material improves the gap filling properties of the foamed adhesive with respect to deflection yoke components with which it is in contact such as the yoke housing/liner, the ferrite cores and the metallic field formers. This reduces the tendency of the deflection yoke to vibrate during operation which causes audible noise. The dry, inert gas goes into solution in the hot melt adhesive and is dispensed onto the surface thereof and rapidly expands as a result of pressure differential within the adhesive. Varying the gas pressure can extend the adhesive or reduce the amount of adhesive used from 20% to 70%. The adhesive material is selected on the basis of its surface tension, viscosity and permeation characteristics using foaming techniques well known to those skilled in the art in order to match end properties with desired performance characteristics. In one preferred embodiment, nitrogen gas is introduced into a hot melt Terlan adhesive. The performance characteristics of the Terlan hot melt adhesive impregnated with nitrogen gas is discussed in the following paragraphs.

Figure 4:
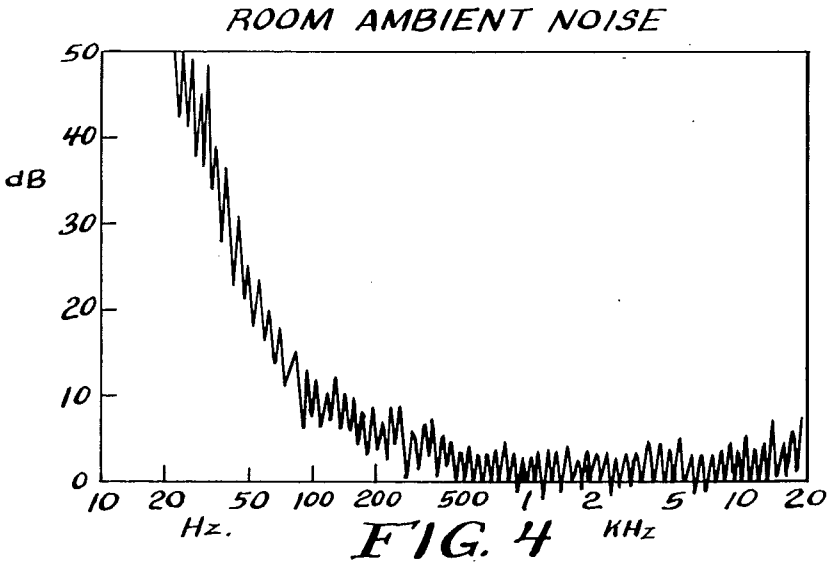
FIG. 4 illustrates the level of sound vibration in a CRT deflection yoke arising from room ambient noise.
Figure 6:
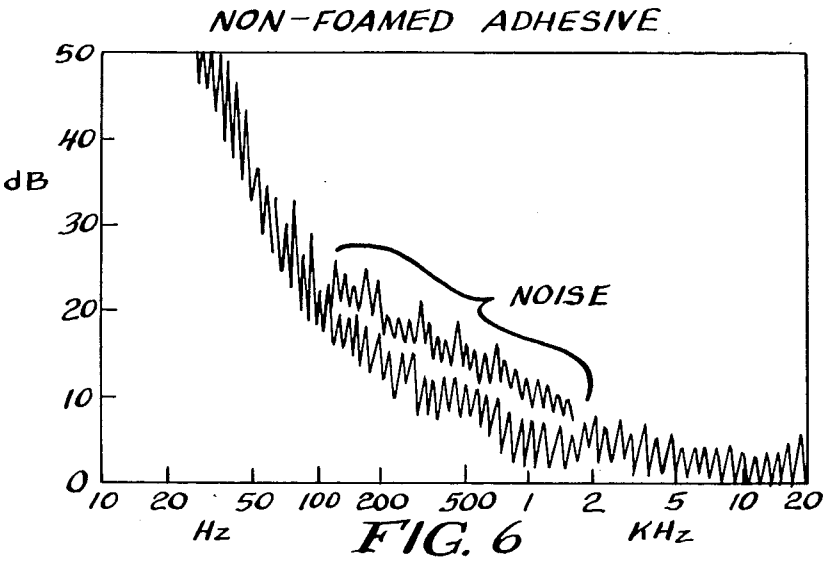
FIG. 6 illustrates the sound vibration level in a CRT deflection yoke incorporating a non-foamed adhesive.
Figure 5:
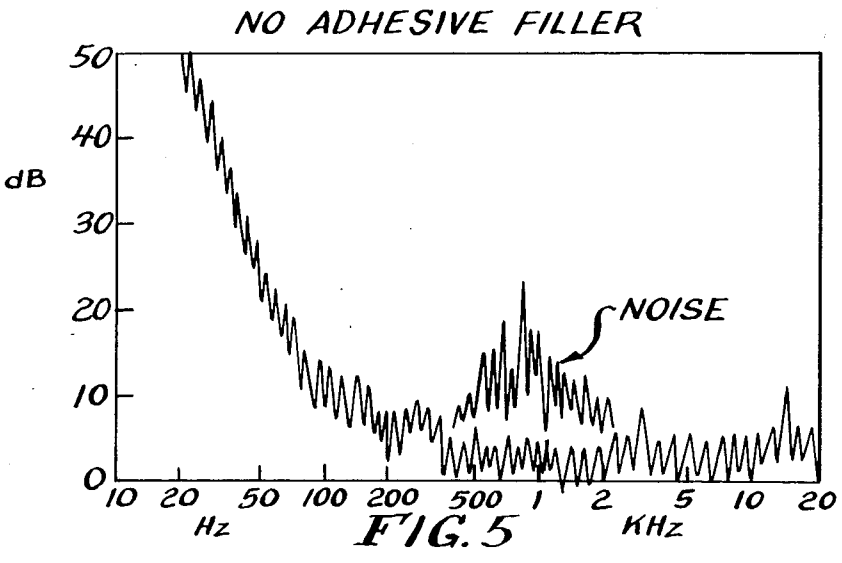
FIG. 5 illustrates the sound vibration level in a CRT deflection yoke which does not incorporate an adhesive filler.
Figure 7:
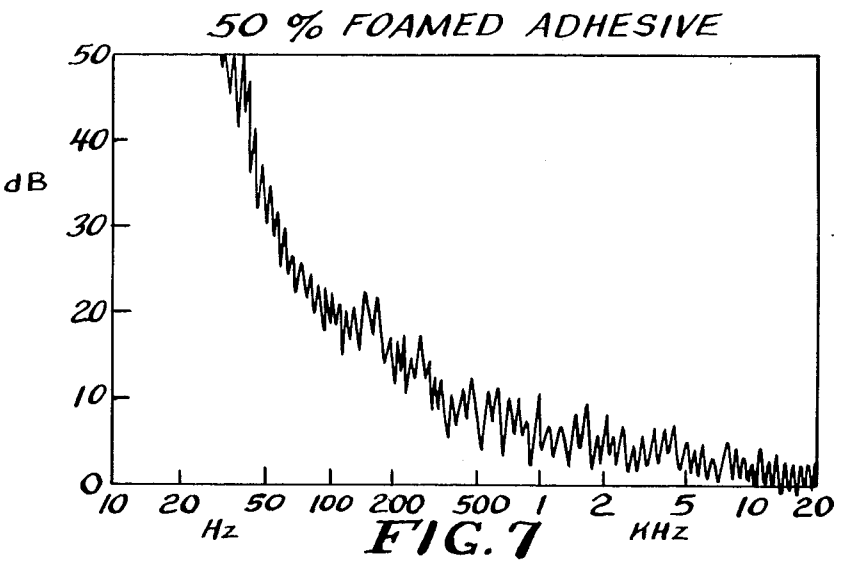
FIG. 7.illustrates the sound vibration level in a CRT deflection yoke incorporating an adhesive which is 50% foamed.

Referring to FIG. 4, there is shown the sound level at various frequencies as measured in dBs in a conventional CRT deflection yoke arising from ambient noise in the room in which the deflection yoke is located. It can be seen that at frequencies below approximately 200 Hz the noise generated by the deflection yoke increases substantially as the frequency drops to approximately 20 Hz. FIG. 5 shows similar sound level measurements from a deflection yoke during operation with a CRT as measured in an anechoic chamber for a deflection yoke which includes no adhesive filler. From this figure, it can be seen that the noise level of the deflection yoke increases substantially within the approximate frequency range of from 400 Hz to 2 kHz. FIG. 6 illustrates the noise in a CRT deflection yoke during operation for a deflection yoke having a non-foamed adhesive positioned adjacent to and in intimate contact with the yoke's ferrite cores, deflection coils and field formers. From FIG. 6 it can be seen that while large noise peaks have been eliminated from the deflection yoke, there is still an increase in the noise generated by the deflection yoke over a frequency range of from approximately 100 Hz to 2 kHz. Finally, FIG. 7 illustrates the sound generated by a CRT deflection yoke which includes a foamed adhesive material having 50% gas by volume distributed therein. From FIG. 7, it can be seen that by foaming the hot melt adhesive prior to positioning it in intimate contact with the yoke housing/liner, the ferrite cores, deflection windings and magnetic field formers a substantial reduction in the sound vibration of the deflection yoke is realized. Dampened vibration in the deflection yoke results in improved thermal dissipation, enhanced video image presentation, and greater structural strength in the deflection yoke.

There has thus been shown an improved CRT deflection yoke incorporating a foamed hot melt adhesive material for securely coupling various components of the yoke. The foamed adhesive increases the structural support under compressive conditions in the deflection yoke, eliminates hot spots and improves thermal dissipation, fills up gaps in the yoke structure and thus dampens out low frequency vibrations, and reduces the amount of foamed material required in the manufacture and fabrication of deflection yokes making them cheaper to produce.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A magnetic deflection yoke comprising:

a generally circular, elongated housing;

a generally circular ferrite core positioned upon and around said housing in tight-fitting relation;

a plurality of magnetic deflection coils wrapped around said ferrite core;

a plurality of magnetic field formers positioned on said housing and disposed about said ferrite core; and a foamed adhesive material disposed in intimate contact with said housing, said ferrite core and magnetic deflection coils and said magnetic field formers for increasing the strength of said deflection yoke and removing heat therefrom.

2. The magnetic deflection yoke of claim 1 wherein said foamed adhesive material is comprised of a thermoplastic material having a plurality of gas bubbles therein.

3. The magnetic deflection yoke of claim 2 wherein said gas bubbles contain an inert gas.

4. The magnetic deflection yoke of claim 3 wherein said inert gas is nitrogen.

5. The magnetic deflection yoke of claim 3 wherein said inert gas is carbon dioxide.

6. The magnetic deflection yoke of claim 2 wherein said thermoplastic material is polyethylene.

7. The magnetic deflection yoke of claim 2 wherein said thermoplastic material is polypropylene.

8. The magnetic deflection yoke of claim 1 including first and second magnetic field formers positioned in spaced relation around and upon said housing.

9. The magnetic deflection yoke of claim 2 wherein said foamed adhesive material is comprised of from 20% to 70% of said gas bubbles in volume.

* * * * *